US008698854B2

(12) United States Patent
Lee

(10) Patent No.: US 8,698,854 B2
(45) Date of Patent: Apr. 15, 2014

(54) ORGANIC LIGHT EMITTING DIODE DISPLAY DEVICE AND LOW POWER DRIVING METHOD THEREOF

(75) Inventor: Hyunjae Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 282 days.

(21) Appl. No.: 13/236,825

(22) Filed: Sep. 20, 2011

(65) Prior Publication Data

US 2012/0069059 A1 Mar. 22, 2012

(30) Foreign Application Priority Data

Sep. 20, 2010 (KR) ..... 10-2010-0092500

(51) Int. Cl.
*G09G 5/10* (2006.01)

(52) U.S. Cl.
USPC ..... 345/690; 345/76; 345/211

(58) Field of Classification Search
None
See application file for complete search history.

(56) References Cited

U.S. PATENT DOCUMENTS

| | | | | |
|---|---|---|---|---|
| 8,334,824 | B2 * | 12/2012 | Park | 345/82 |
| 2009/0219275 | A1 * | 9/2009 | Jeon | 345/212 |
| 2010/0123701 | A1 * | 5/2010 | Yeo | 345/211 |

* cited by examiner

*Primary Examiner* — Jason Olson
(74) *Attorney, Agent, or Firm* — Morgan, Lewis & Bockius LLP

(57) ABSTRACT

An organic light emitting diode (OLED) display and a low power driving method of the OLED display are provided. The OLED display comprises a display panel that comprises data lines, scan lines intersecting the data lines, and light emitting cells arranged in a matrix form, wherein the light emitting cells respectively comprise OLEDs, a DC-DC converter that is enabled in a normal mode to supply a first high potential power voltage to the display panel and is disabled in a low power mode, and a panel driver that drives the data lines and the scan lines of the display panel, disables the DC-DC converter in the low power mode, and supplies a second high potential power voltage to the display panel.

17 Claims, 11 Drawing Sheets

① Display OFF(28h)

② Write DLP image
(Phone SW should wait for TE signal)

③ Define partial area size(30h)
← practically whole screen = 864 lines

④ Partial mode ON(12h)

⑤ Idle mode ON(39h) ← From this command, minimum 1 Frame delayed

⑥ Display ON(29h)

※ Register order between 12h and 39h can be inverted

ORGANIC LIGHT EMITTING DIODE DISPLAY DEVICE AND LOW POWER DRIVING METHOD THEREOF

This application claims the benefit of Korea Patent Application No. 10-2010-0092500 filed on Sep. 20, 2010, the entire contents of which is incorporated herein by reference for all purposes as if fully set forth herein.

BACKGROUND

1. Field

The embodiments of the present document are directed to an organic light emitting diode (OLED) display and a low power driving method of the OLED display.

2. Discussion of the Related Art

Various flat panel displays (FPDs) have been developed that may replace cathode ray tube (CRT) displays disadvantageous in light of the weight and size. Exemplary FPDs include liquid crystal display (LCDs), field emission displays (FEDs), plasma display panel (PDP) displays, and electroluminescence device (ED) displays.

ED displays are categorized into inorganic types and organic types that may be commonly referred to as "organic light emitting diode (OLED) displays". As self-emitting elements, OLEDs have a number of advantages, for example, such as rapid response speed, and high light emission efficiency, brightness, and view angle.

An OLED display may be driven by various methods a few examples of which include voltage driving, voltage compensating, current driving, digital driving, or external compensating methods. Also, a voltage compensation driving method is one of the methods of driving the OLED display.

The conventional low-speed parallel connection between devices is not attractive in light of price, power consumption, electromagnetic interference (EMI), or size. The conventional serial interface connection suffers from an increase in complexity and lowering in efficiency in an environment where a number of devices are connected to one another by a point-to-point connection method. To address the problems of the conventional interface circuits, an interface circuit technology has been advancing toward a low voltage, high-speed serial transfer. The MIPI (Mobile Industry Processor Interface), which is a standardized serial interface, shows an optimum achievement in mobile environments with low voltage and high data rate.

A mobile LCD with an MIPI interface may be shifted into a low power mode for low power driving by a standard command. The low power mode is also referred to as "partial idle mode (PIM)" or "dimmed low power (DLP) mode". The low power mode renders the mobile LCD to operate with low power consumption, for example, by turning off the backlight unit. In the low power mode, the mobile LCD displays preset vide data by reflecting external light like a reflective type LCD, and arbitrary adjustment of brightness is thus impossible.

The low power mode may not apply to the OLEDs which are self emitting elements. A PIM driving method optimized with the self emitting OLEDs has not been yet developed. In the case of being driven in the low power mode, the OLEDs may exhibit an abnormal visual effect as entering into the low power mode.

SUMMARY

Exemplary embodiments of the present document provide an OLED display and a low power driving method of the OLED display that may prevent the abnormal visual effect in the low power mode with minimized power consumption.

According to an embodiment of the present document, there is provided an organic light emitting diode (OLED) display comprising a display panel that comprises data lines, scan lines intersecting the data lines, and light emitting cells arranged in a matrix form, wherein the light emitting cells respectively comprise OLEDs, a DC-DC converter that is enabled in a normal mode to supply a first high potential power voltage to the display panel and is disabled in a low power mode, and a panel driver that drives the data lines and the scan lines of the display panel, disables the DC-DC converter in the low power mode, and supplies a second high potential power voltage to the display panel.

wherein the second high potential power voltage is produced in the panel driver.

The DC-DC converter comprises a feedback resistor connected to a high potential driving voltage supply terminal of the display panel and a switch switching on/off a current path between a terminal of the feedback resistor and a ground voltage source, wherein the switch turns on/off in the low power mode under control of the panel driver to cut off the current path.

The panel driver comprises a charge pump that adjusts an input voltage to output the second high potential power voltage, a diode connected to the high potential power voltage supply terminal of the display panel, and a first switch that supplies the second high potential power voltage to the display panel through the diode in the low power mode in response to a mode shifting command input from an external host system.

In the normal mode, the panel driver gamma corrects RGB data for every full bits and supplies the gamma-corrected RGB data to the data lines of the display panel, and in the low power mode, gamma corrects the RGB data only for MSBs and supplies the gamma-corrected RGB data to the data lines of the display panel.

The panel driver comprises a first voltage dividing circuit that produces a gamma reference voltage, a second voltage dividing circuit that separates an output voltage of the first voltage dividing circuit, one or more amplifiers that amplify respective corresponding outputs from the first voltage dividing circuit and supply the amplified outputs to the second voltage dividing circuit, a grayscale voltage generating circuit that generates grayscale voltages by adjusting an output voltage of the second voltage dividing circuit, a decoder that selects a grayscale voltage depending on digital video data, and an output buffer that supplies an output voltage from the decoder to the data lines of the display panel, wherein in the low power mode, only an amplifier that amplifies a uppermost grayscale gamma reference voltage among the one or more amplifiers is enabled and the other amplifiers are disabled.

The panel driver further comprises a fourth switch that switches on/off a current path between an output terminal of the amplifier that amplifies the uppermost grayscale gamma reference voltage and an output terminal of the decoder through which a uppermost grayscale voltage is outputted, a fifth switch that switches on/off a current path between an input terminal and an output terminal of the output buffer, and a sixth switch that switches on/off a current path between the ground voltage source and voltage lines for supply of other grayscale voltages than the uppermost grayscale voltage.

The high potential power voltage supplied to the display panel is lower in the low power mode than in the normal mode.

A frame period of the low power mode is longer than a frame period of the normal mode.

The panel driver supplies a black grayscale voltage to the data lines of the display panel during at least a portion of a time period that shifts from the normal mode to the low power mode.

The panel driver increases a reference voltage supplied to each of the light emitting cells of the display panel at an early stage of the low power mode.

According to an embodiment of the present document, there is provided a low power driving method of an organic light emitting diode (OLED) display comprising a display panel that comprises data lines, scan lines intersecting the data lines, and light emitting cells respectively comprising OLEDs, and a panel driver driving the data lines and the scan lines of the display panel, the method comprising, enabling a DC-DC converter in a normal mode to supply a first high potential power voltage produced from the DC-DC converter to the display panel, and disabling the DC-DC converter in a low power mode to supply a second high potential power voltage produced from the panel driver to the display panel.

BRIEF DESCRIPTION OF THE DRAWINGS

The accompanying drawings, which are included to provide a further understanding of the embodiments of the document and are incorporated in and constitute a part of this specification, illustrate embodiments of the document and together with the description serve to explain the principles of the document. In the drawings.

DETAILED DESCRIPTION OF THE EMBODIMENTS

Figure 1:
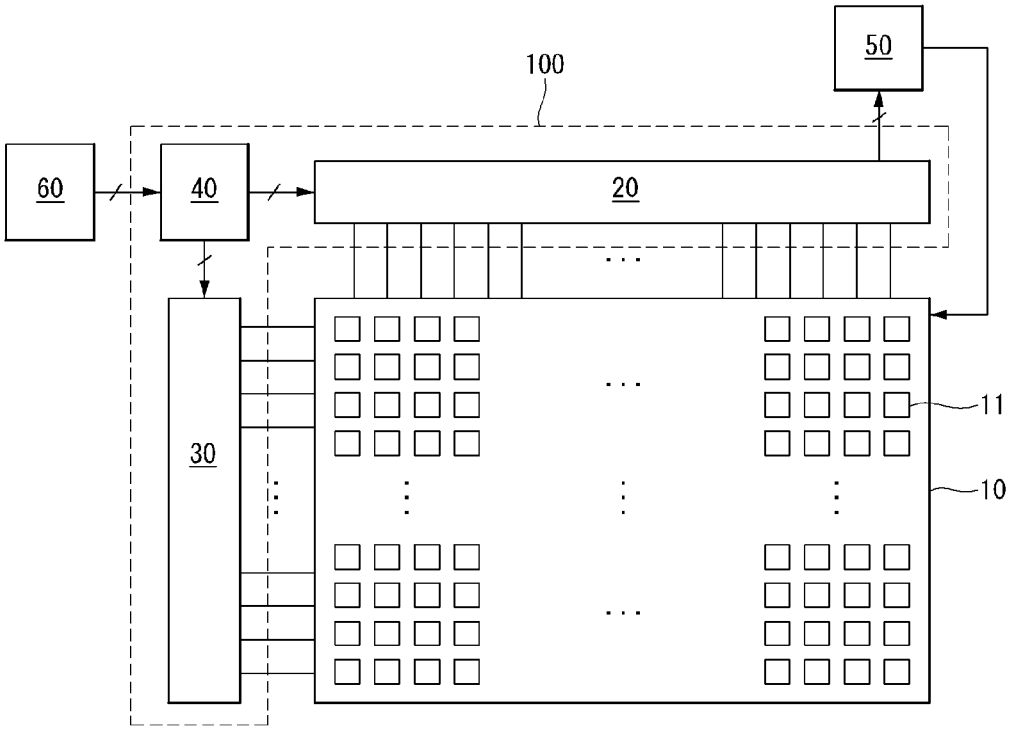
FIG. 1 is a block diagram illustrating an OLED display according to an embodiment of the present document.

Hereinafter, exemplary embodiments of this document will be described with reference to the accompanying drawings, wherein the same reference numerals may be used to denote the same or substantially the same elements throughout the specification and the drawings.

Figure 2:
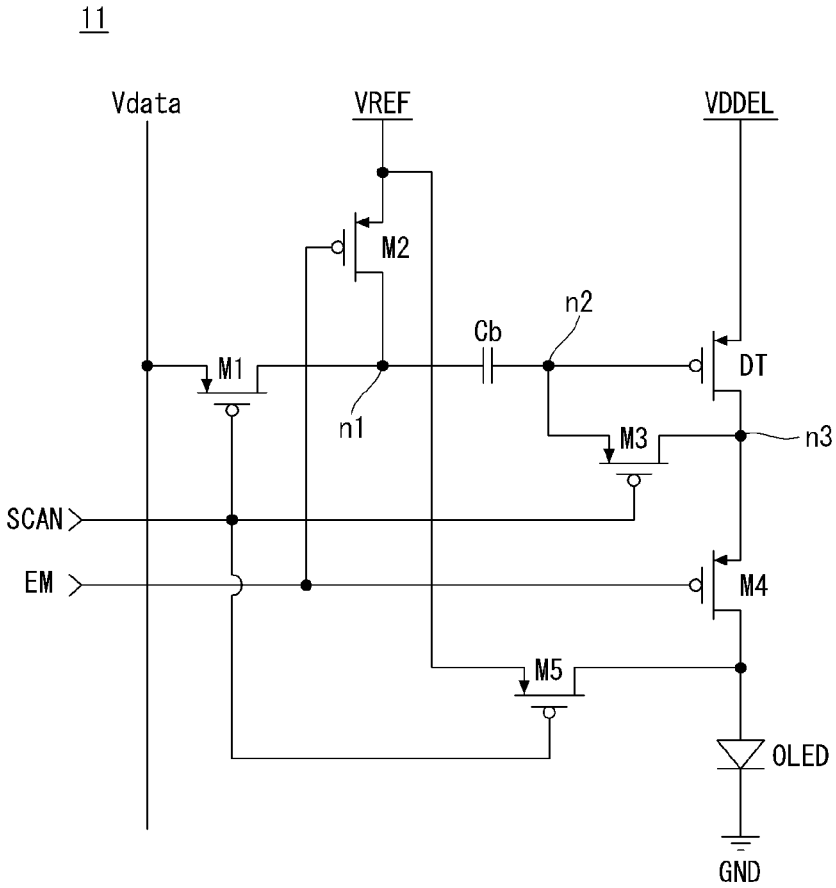
FIG. 2 is a circuit diagram illustrating a light emitting cell of FIG. 1.
Figure 3:
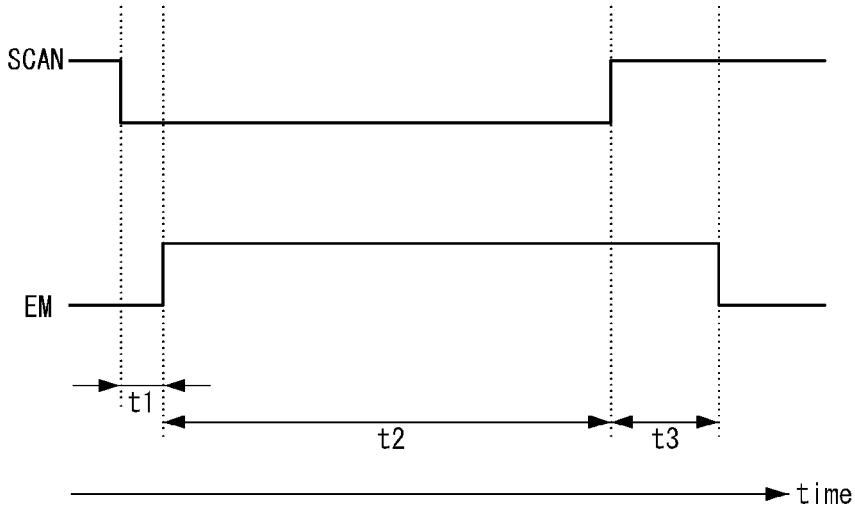
FIG. 3 illustrates waveforms of driving signals of the light emitting cell of FIG. 2.

Referring to FIGS. 1 to 3, an organic light emitting diode (OLED) display according to an embodiment includes a display panel 10, a data driver 20, a scan driver 30, a DC-DC converter 50, and a timing controller 40.

The display panel 10 includes data lines for supply of data voltages, scan lines for sequential supply of scan pulses SCAN and light emitting control pulses EM, and light emitting cells 11 arranged in the form of a matrix. The data lines intersect the scan lines. The light emitting cells 11 are supplied with high potential power voltages VDDEL.

The light emitting cells 11 each includes a plurality of thin film transistors (TFTs), a capacitor Cb, and an OLED as shown in FIG. 2. The light emitting cells 11 are initialized in response to scan pulses SCAN and sample threshold voltages of driving TFTs (DT). The OLED emits light by a current flowing through a driving TFT that is driven by a data voltage obtained by compensating a threshold voltage of the driving TFT during a low logic state (or emission period) of a light emitting control pulse EM.

The data driver 20 converts digital video data RGB into a gamma compensation voltage under control of the timing controller 40 to output a data voltage, and supplies the data voltage to the data lines. The scan driver 30 supplies the scan pulse SCAN and light emitting control pulse EM to the scan lines under control of the timing controller 40.

In a normal mode that normally displays input digital video data, the DC-DC converter 50 is enabled to produce a high potential power voltage VDDEL for driving the light emitting cells 11. In a low power mode, the DC-DC converter 50 is disabled with no output.

In the normal mode, the timing controller 40 supplies input digital video data from a host system 60 to the data driver 20, and in the low power mode, supplies low power data prestored in an internal memory to the data driver 20. The low power data may be screen data that displays a low-brightness time with a black-grayscale background. According to an embodiment, the low power data may be various types of DLP image data. The timing controller 40 produces timing control signals for controlling operation timing of the data driver 20 and the scan driver 30 based on an external timing signals such as vertical/horizontal sync signals and clock signals input from the host system 60. The vertical sync signal is generated once at a start time of a frame period as shown in FIGS. 5 to 9—for example, the vertical sync signal may function as a TE (Tearing Effect) signal for distinguishing a frame period from another.

The host system 60 is connected to a communication module (not shown), a camera module (not shown), an audio processing module (not shown), an interface module (not shown), a battery (not shown), a user input device (not shown), and the timing controller 40. The host system 60 supplies a mode shifting command to the timing controller 40 to shift the normal mode to the low power mode in response to a user's command, a communication stand-by state, or a data non-input counting result.

The data driver 20, the scan driver 30, and the timing controller 40 may be integrated to a panel driver chip 100 that is a single chip. In response to the mode shifting command from the host system 60, the panel driver chip 100 enables the DC-DC converter 50 in the normal mode and supplies power from an internal power source (not shown) to the light emitting cells 11 of the display panel 10 in the low power mode while simultaneously disabling the DC-DC converter 50.

Each light emitting cell 11 includes an OLED, six TFTs M1 to M5 and DT, and a capacitor Cb as shown in FIG. 2. Driving voltages, such as a high potential power voltage VDDEL, a base voltage VSS or GND, or a reference voltage VREF, are supplied to each light emitting cell 11. The TFTs M1 to M5 and DT may include p-type metal oxide semiconductor field effect transistors (MOSFETs). According to embodiments, the light emitting cell 11 may have various configurations. For example, the number and connections of the TFTs may vary in part. Accordingly, the embodiments of the present document are not limited thereto.

The high potential power voltage VDDEL is about 10V DC. The reference voltage Ref is set such that a difference from the base voltage GND is less than a threshold voltage of the OLED. For example, the reference voltage VREF may be set to be equal to about 2V.

When the reference voltage VREF is applied to the anode of the OLED and the based voltage GND is applied to the cathode of the OLED, the OLED does not turn on, thus failing to emit light. The reference voltage VREF may be set as a negative voltage so that a reverse bias may be applied to the OLED when initializing a driving TFT (DT) connected to the OLED. Since the reverse bias is periodically applied to the OLED, the OLED is less likely to be deteriorated, thus increasing the lifespan of the OLED.

The first switching TFT M1 applies a data voltage Vdata from a data line to a first node n1 in response to a scan pulse SCAN of a low logic level, which is generated during first and second time periods t1 and t2 as shown in FIG. 3. The third switching TFT M3 forms a current path between the first node n1 and a second node n3 in response to the low logic level scan pulse SCAN generated during the first and second time periods t1 and t2, thereby making the driving TFT DT operate as a diode. The fifth switching TFT M5 supplies the reference voltage VREF to the anode of the OLED in response to the low logic level scan pulse SCAN during the first and time periods t1 and t2. The source of the first switching TFT M1 is connected to the data line that is connected to the first node n1. The gate of the first switching TFT M1 is connected to a scan line supplied with the scan pulse SCAN. The source of the third switching TFT M3 is connected to the second node n2, and the drain of the third switching TFT M3 is connected to a third node n3. The gate of the third switching TFT M3 is connected to the scan line supplied with the scan pulse SCAN. The reference voltage VREF is supplied to the source of the fifth switching TFT M5 whose drain is connected to the anode of the OLED. The gate of the fifth switching TFT M5 is connected to the scan line supplied with the scan pulse SCAN. The first node n1 is connected to the drains of the first and second switching TFTs M1 and M2 and a terminal of the capacitor Cb. The second node n2 is connected to the other terminal of the capacitor Cb, the gate of the driving TFT DT, and the source of the third switching TFT M3. The third node n3 is connected to the drains of the third switching TFT M3 and the driving TFT DT, and the source of the fourth switching TFT M4.

The second and fourth switching TFTs M2 and M4 turn off in response to a high logic level light emitting control pulse EM during the second and third time periods t2 and t3 as shown in FIG. 3, and maintain ON during the remaining time. The reference voltage VREF is supplied to the source of the second switching TFT M2 whose drain is connected to the first node n1. The gate of the second switching TFT M2 is connected to the scan line supplied with the light emitting control pulse EM. The source of the fourth switching TFT M4 is connected to the third node n3, and the drain of the fourth switching TFT M4 is connected to the anode of the OLED and the drain of the fifth switching TFT M5. The gate of the fourth switching TFT M4 is connected to the scan line supplied with the light emitting control pulse EM.

The capacitor Cb is connected between the first node n1 and the second node n2 to be electrically charged with a difference voltage between voltages respectively applied to the first and second nodes n1 and n2, thus sampling the threshold voltage of the driving TFT DT. The threshold voltage-compensated data voltage Vdata is applied from the capacitor Cb to the gate of the driving TFT DT, so that the amount of current flowing across the OLED may be adjusted depending on the threshold voltage-compensated data voltage Vdata. The high potential power voltage VDDEL is supplied to the source of the driving TFT DT whose drain is connected to the third node n3. The gate of the driving TFT DT is connected to the second node n2.

The anode of the OLED is connected to the drains of the fourth and fifth switching TFTs M4 and M5, and the cathode of the OLED is connected to the ground voltage source GND. A current flowing across the OLED, referred to as $I_{OLED}$ in Equation 1, is not affected by a threshold voltage deviation of the driving TFT DT or the high potential power voltage VDDEL as can be seen from Equation 1:

$$I_{OLED}=k(V\text{data}-V\text{REF})^2, k=\tfrac{1}{2}(\mu CoxW/L) \qquad \text{Equation 1}$$

Here, 'K' is a constant that has the above relationship among 'μ', 'Cox', and 'W/L' that respectively refer to a mobility, parasitic capacity, and channel ratio of the driving TFT DT.

Figure 4:
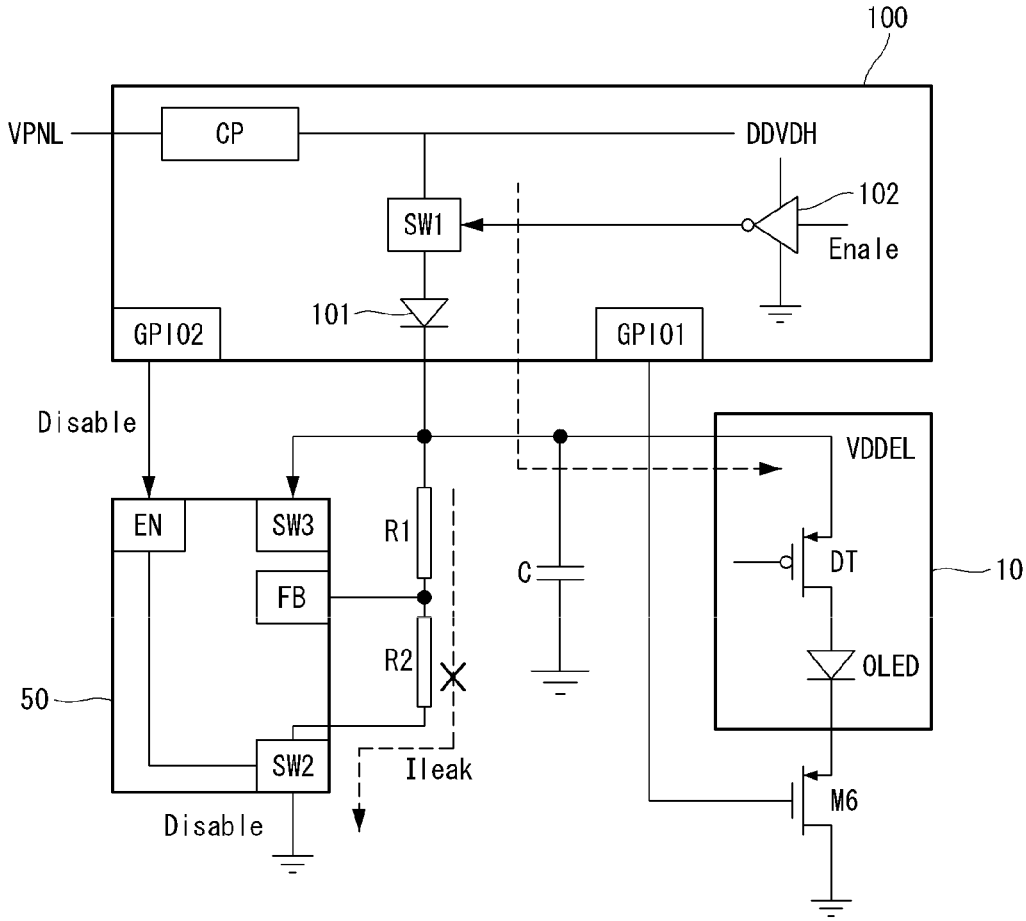
FIG. 4 illustrates a disabling operation of the DC-DC converter and a switching operation of the high potential power voltage VDDEL under control of the panel driver chip in the low power mode.

The cathode of the OLED is connected to the ground voltage source GND through a sixth switching TFT M6 as shown in FIG. 4. The sixth switching TFT M6 is an N-type MOSFET (NMOS). The sixth switching TFT M6 is mounted on a printed circuit board (PCB) on which the panel driver chip 100 is also mounted. The sixth switching TFT M6 controls light emission of the OLED in the normal or low power mode. The sixth switching TFT M6 is jointly connected to all of the pixels. Accordingly, a single sixth switching TFT M6 is mounted on the PCB. The source of the sixth switching TFT M6 is connected to the cathodes of the OLEDs formed at respective corresponding pixels, and the drain of the sixth switching TFT M6 is connected to the ground voltage source GND. he gate of the sixth switching TFT M6 is connected to a first low power mode control terminal GPIO1 of the panel driver chip 100. When a voltage outputted from the first low power mode control terminal GPIO1 is at a high logic level, the sixth switching TFT M6 maintains an ON state so that the OLEDs of the pixels 11 are connected to the ground voltage source GND. When the voltage outputted from the first low power mode control terminal GPIO1 turns to a low logic level, the sixth switching TFT M6 turns off to cut off the current path between the OLEDs of the pixels 11 and the ground voltage source GND.

FIG. 4 illustrates a disabling operation of the DC-DC converter 50 and a switching operation of the high potential power voltage VDDEL under control of the panel driver chip 100 in the low power mode. FIG. 4 shows only part of a circuit configuration including the panel driver chip 100, the DC-DC converter 50, and the display panel 10, which involves switching of the high potential power voltage VDDEL in the low power mode.

Referring to FIG. 4, the panel driver chip 100 includes a charge pump (CP), a first switch SW1, and a diode 101.

The charge pump CP converts a DC voltage from a battery which ranges from about 2.3V to about 4.8V into a DC voltage DDVDH which is about 6V. The DC voltage DDVDH is transformed into a scan pulse high potential voltage (or gate high voltage, VGH of FIG. 9) and a scan pulse low potential voltage (or gate low voltage, VGH of FIG. 9) by a regulator (not shown). The high potential voltage VGH is equal to or higher than the DC voltage DDVDH.

The panel driver chip 100 adjusts the DC voltage DDVDH outputted from the charge pump CP to the reference voltage VREF using the regulator, and supplies the adjusted voltage to each of the pixels 11 of the display panel 10 through a power capacitor. The panel driver chip 100 adjusts the potential of the reference voltage VREF in the low power mode by the method to be described in connection with FIGS. 5 to 9.

The first switch SW1 turns on in response to a mode shifting command inputted from the host system 60 through a buffer 102. The mode shifting command is generated at a high logic level in the normal mode and at a low logic level in the low power mode. The first switch SW1 is an N-type MOSFET (NMOS) that includes a drain connected to the output terminal of the charge pump CP, a source connected to the anode of a diode 101, and a gate connected to the reverse output terminal of the buffer 102. When a mode shifting command is generated at a high logic level in the normal mode, a reverse output voltage from the buffer 102 has a low logic level. In the normal mode, the first switch SW1 maintains an OFF state to block a current path between the charge pump CP and the diode 101. In the low power mode, the mode shifting command is reversed to the low logic level, and the reverse output voltage from the buffer 102 is reversed to the high logic level. In the low power mode, the first switch SW1 turns on to form a current path between the charge pump CP and the diode 101 and supplies the output voltage DDVDH from the charge pump CP to the diode 101.

In response to the mode shifting command from the host system 60, the panel driver chip 100 reverses an enable/disable signal outputted through a second low power mode control terminal GPIO2. For example, the panel driver chip 100 outputs an enable/disable signal having a high logic level through the second low power mode control terminal GPIO2 in the normal mode to enable the DC-DC converter 50, and outputs an enable/disable signal having a low logic level through the second low power mode control terminal GPIO2 in the low power mode to disable the DC-DC converter 50.

The DC-DC converter 50 includes an enable terminal EN connected to the second low power mode control terminal GPIO2 of the panel driver chip 100 and a second switch SW2. The DC-DC converter 50 is enabled in response to the high logic level enable/disable signal in the normal mode, thereby producing a high potential power voltage VDDEL whose magnitude is about 10 to divide the pixels 11 of the display panel 10. In response to the high logic level enable/disable signal in the normal mode, the second switch SW2 connects a second resistor R2 to the ground voltage source GND, wherein a feedback voltage dividing resistor circuit includes a first resistor R1 and the second resistor R2. The first resistor R1 is connected to the high potential power voltage supplying terminal of the display panel 10 and a capacitor C. The second switch SW2 is an N-type MOSFET (NMOS) that includes a source connected to the second resistor R2, a drain connected to the ground voltage source GND, and a gate to which an enable/disable signal is applied through the enable terminal EN. The DC-DC converter 50 detects a variation of a feedback signal inputted to the feedback terminal FB through the feedback voltage dividing resistor circuit R1 and R2 to adjust the high potential power voltage VDDEL to be supplied to the display panel 10, thereby constantly maintaining the high potential power voltage VDDEL supplied to the pixels 11 of the display panel 10 even when load of the display panel 10 is changed.

In response to a low logic level enable/disable signal in the low mode, the DC-DC converter 50 is disabled to produce no output. In response to a low logic level enable/disable signal in the low power mode, the second switch SW2 turns off to cut off a leaking current Ileak flowing through the feedback voltage dividing resistor circuit R1 and R2 to the ground voltage source GND, thereby minimizing power consumption.

The third switch SW3 of the DC-DC converter 50 may be used for discharging electric charges remaining at the power capacitor C. According to an embodiment, it is assumed that the third switch SW3 maintains an OFF state in the normal and low power modes. However, the embodiments of the present document are not limited thereto, and various embodiments may be available depending on design purposes.

When the normal mode shifts to the low power mode, the high potential power voltage VDDEL that has been generated from the DC-DC converter 50 in the normal mode is cut off, and the DC voltage DDVDH output from the charge pump CP of the panel driver chip 100 is supplied to the light emitting cells 11 of the display panel 10 through the diode 101. Accordingly, the high potential power voltage VDDEL supplied to the light emitting cells 11 of the display panel 10 is about 10V in the normal mode, and is lowered to a voltage which subtracts a threshold voltage of the diode 101 from 6V as the normal mode shifts to the low power mode.

The anode of the diode 101 is connected to the first switch SW1. The cathode of the diode 101 is connected to the first resistor R1, the high potential power voltage supply terminal of the display panel 10, and the capacitor C. According to an embodiment, the diode 101 is a shottky diode that may operate at high speed.

Figure 5:
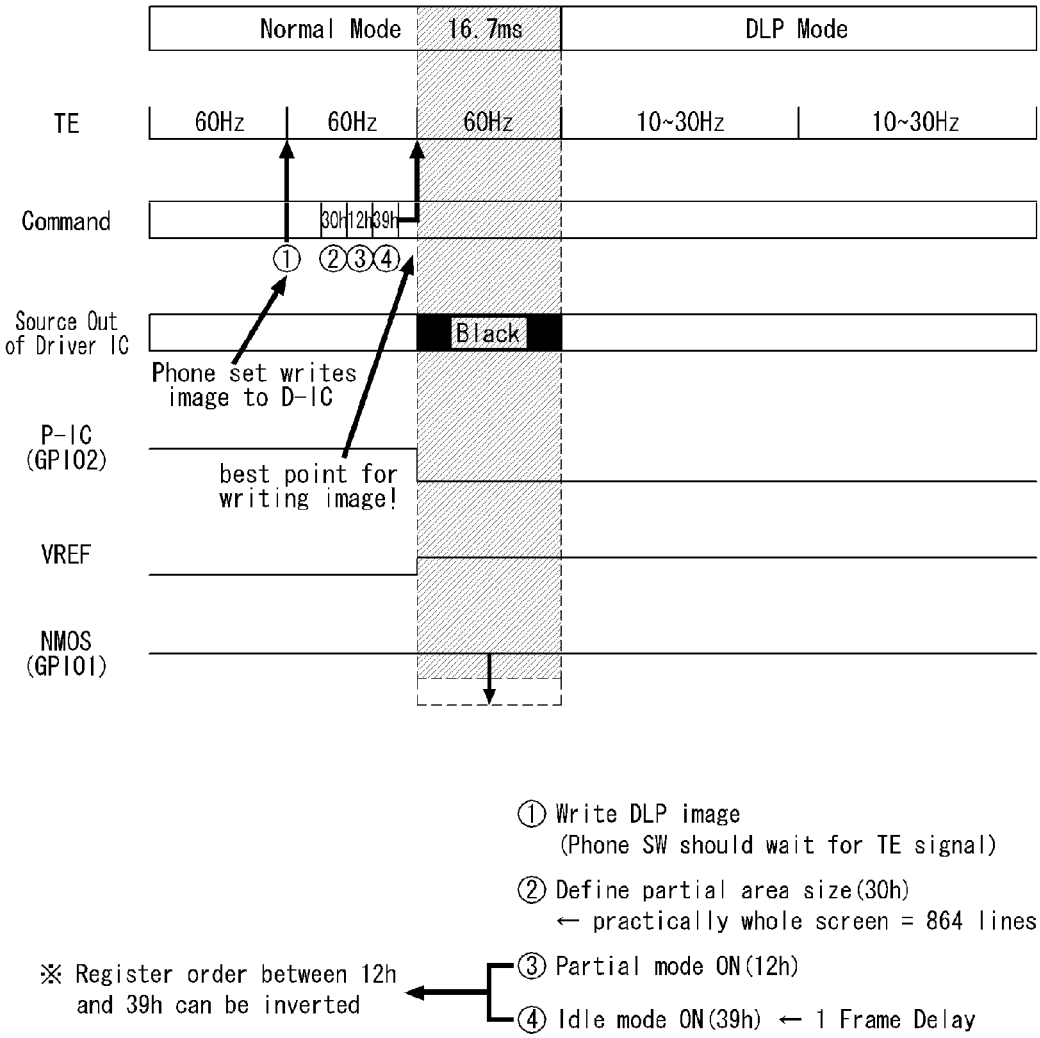
FIG. 5 illustrates an exemplary operation of an OLED display according to an embodiment of the present document while the normal mode shifts to the low power mode.

FIG. 5 illustrates an exemplary operation of an OLED display while the normal mode shifts to the low power mode.

Referring to FIG. 5, it is assumed that the normal mode lasts from an n−1th frame period to an (n+1)-th frame period, and the low power mode (DLP mode) lasts during (n+2)-th and (n+3)-th frame periods (where 'n' is a natural number). The frame periods of the low power mode are set to be longer than the frame periods of the normal mode. For example, a frame frequency is 60 Hz in the normal mode, and a frame frequency is 5-35 Hz in the low power mode. The frame frequency in the low power mode may vary from 5 Hz to 35 Hz.

To enter into the low power mode from the normal mode, the host system 60 produces a DLP image write command ① at a start time of an nth frame period in synchronization with an nth TF signal pulse. Then, the host system 60 sequentially produces a define partial area size command ① a partial mode ON ③, and an idle mode ④.

In response to the DLP image write command ①, the panel driver chip 100 starts to write DLP image data input from the host system 60 in an internal frame memory SRAM from a start time of the (n+1)-th frame period. The DLP image data includes only low grayscale minimum data, for example, time data. Subsequently, the panel driver chip 100 defines a display area of displaying the DLP image data in response to the define partial area size command ②. Upon identifying receipt of the partial mode ON ③ and the idle mode ④, the panel driver chip 100 supplies a black grayscale data voltage to the data lines of the display panel 10 during the (n+1)-th frame period in synchronization with the (n+1)-th TE signal pulse, thereby displaying a black grayscale on the whole screen of the display panel 10. During the (n+1)-th frame period, a data output channel voltage of the panel driver chip 100 is maintained as the base voltage GND that corresponds to a black grayscale voltage. All of the pixels of the display panel 10 turn off to display a black grayscale during the (n+1)-th frame period, thus preventing an abnormal screen from appearing when the host system 60 enters from the normal mode into the low power mode (DLP mode).

Figure 10:
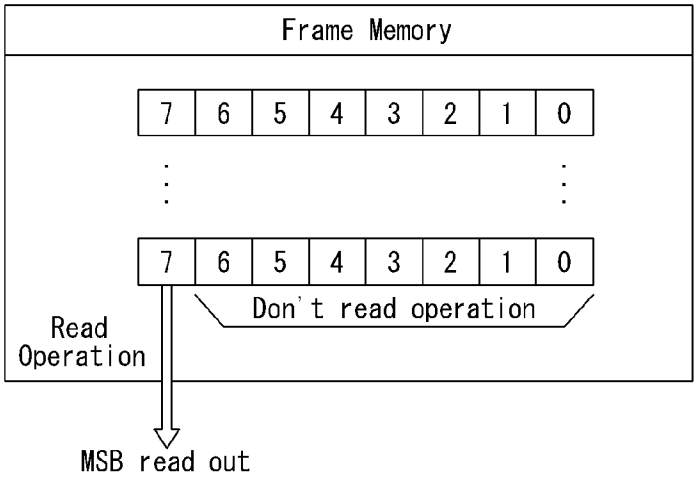
FIG. 10 illustrates a reading operation of a memory in a low power mode according to an embodiment of the present document.

The panel driver chip 100 supplies the DLP image data to the data lines of the display panel 10 from the (n+2)-th frame period when the low power mode starts. The panel driver chip 100 reads out only the three MSBs (Most Significant Bits) each originating from each RGB data from the internal frame memory SRAM and supplies the read three MSBs to the data lines of the display panel 10. That is, for each pixel data of the DLP image data, 24 bits of RGB data—each of RGB data has 8 bits and RGB data thus total 24 bits—are stored in the internal frame memory SRAM, and the MSBs of the RGB data are read out one by one in the low power mode as shown in FIG. 10. Accordingly, the panel driver chip 100 reads out only the three MSBs in the low power mode and converts the three MSBs with an analogue gamma compensation voltage, thereby displaying the DLP image data only with $2^3$=8 colors in the low power mode. The panel driver chip 100 reads out only the three MSBs from the frame memory SRAM in the low power mode and performs gamma correction on only the three MSBs, thus minimizing power consumption. Every 24 bits of pixel data (3 of R, G, and B×8 bits for each R, G, and B=24 bit) are written in the internal memory SRAM of the display panel 10 in the normal mode, and every 24 bits are read out for reproducing a full color.

At a start time of the (n+1)-th frame period which is one frame after the panel driver chip 100 has received the DLP image write command ①, the panel driver chip 100 reveres an output voltage of the second low power mode control terminal GPIO2 to a low logic level to disable the DC-DC converter 50 and supplies an output voltage of the charge pump CP to the pixels 11 of the display panel 10 as the high potential power voltage VDDEL. From the start period of the (n+1)-th frame period, the panel driver chip 100 disables the DC-DC converter 50 while maintaining the low power mode and enables the DC-DC converter 50 when reentering into the normal mode.

At the start time of the (n+1)-th frame period, the panel driver chip 100 increases the reference voltage VREF and then keeps the increased reference voltage VREF constant in the low power mode. Increasing the reference voltage VREF may lower current flowing through the OLEDs of the pixels 11, thus decreasing power consumption. The entire brightness of the display panel 10 is lower in the low power mode than in the normal mode. Accordingly, even though the reference voltage VREF is increased, a contrast ratio may be adjusted to have a level similar to that of a contrast ratio in the normal mode. When reentering into the normal mode, the panel driver chip 100 decreases the reference voltage VREF.

Figure 11:
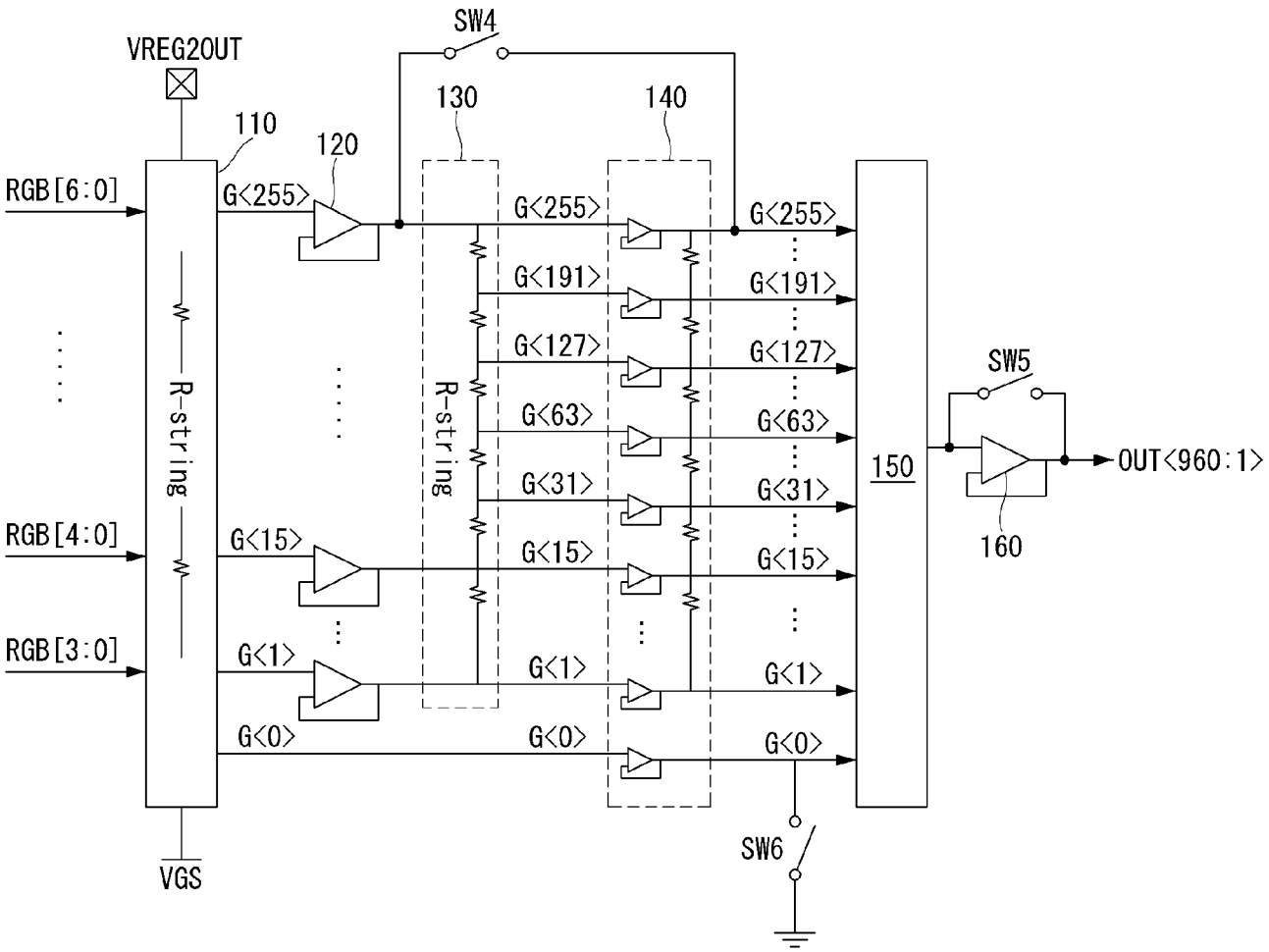
FIG. 11 is a view illustrating a gamma correction circuit of the panel driver chip.

The panel driver chip 100 may adjust the brightness of the display panel 10 in a range from 5 to 50 Nit in the low power mode by changing a voltage of VREG2OUT and an output of an amplifier 120 shown in FIG. 11.

The panel driver chip 100 may keep a voltage of the first low power mode control terminal GPIO1 at a high logic level in the normal and low power modes, or alternatively, may reverse the voltage of the first low power mode control terminal GPIO1 to a low logic level from one frame before entering into the low power mode. When the voltage of the first low power mode control terminal GPIO1 is at the low logic level, the sixth switching TFT M6 turns off to cut off a current path between the OLEDs of the pixels 11 and the ground voltage source, thereby preventing leaking current from occurring at the OLEDs.

Figure 6:
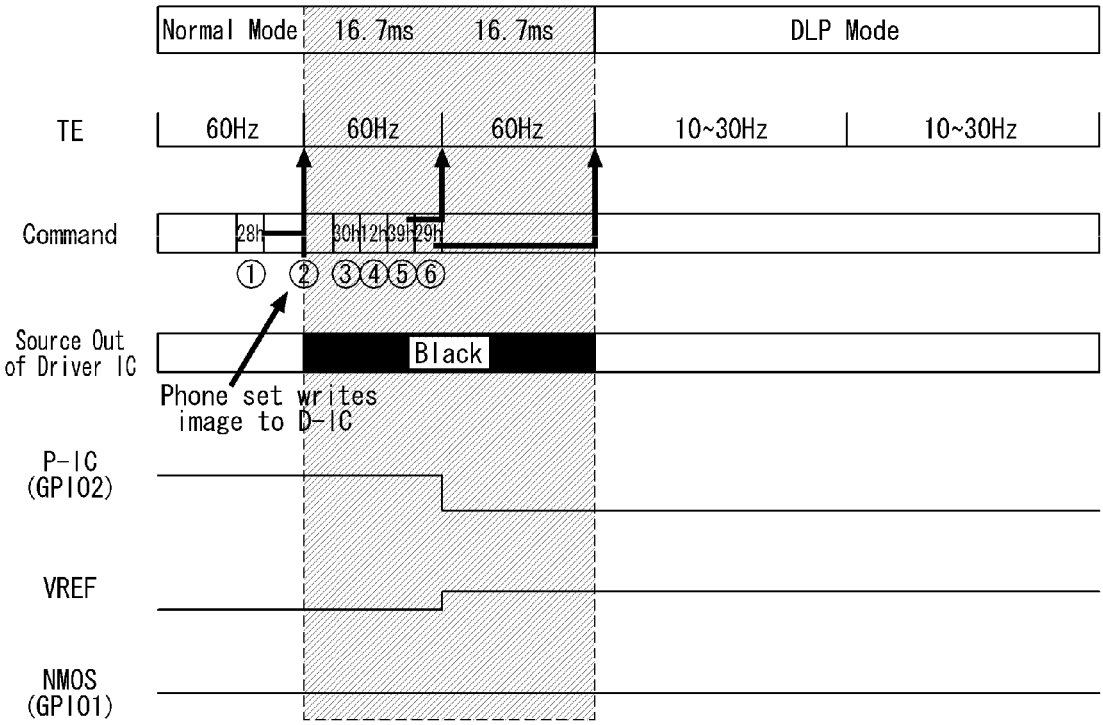
FIG. 6 is a timing diagram illustrating an operation of an OLED display according to an embodiment of the present document while the normal mode shifts to the low power mode.

FIG. 6 is a timing diagram illustrating an operation of an OLED display while the normal mode shifts to the low power mode.

Referring to FIG. 6, it is assumed that the normal mode lasts from an n−1th frame period to an (n+1)-th frame period, and the low power mode (DLP mode) lasts during (n+2)-th and (n+3)-th frame periods.

The host system 60 sequentially generates mode shifting commands, such as Display OFF ①, Write DLP image ②, Define partial area size ③, Partial mode ON ④, and Idle Mode ON ⑤, Display ON ⑥, during an n−1th to an nth frame periods to enter from the normal mode into the low power mode. The Display OFF ① is received by the panel driver chip 100 during the n−1th frame period, and the Write DLP image ②, Define partial area size ③, Partial mode ON ④, Idle Mode ON ⑤, and Display ON ⑥ are sequentially received by the panel driver chip 100 during the nth frame period. The Write DLP image ② is synchronized with an n TE pulse.

In response to the Display OFF ① and Write DLP image ②, the panel driver chip 100 supplies a black grayscale voltage to the data lines of the display panel 10 during the nth frame period, and writes DLP image data input from the host system 60 to an internal frame memory SRAM. Subsequently, the panel driver chip 100 supplies a black grayscale voltage to the data lines of the display panel 10 during the (n+1)-th frame period in response to the Define partial area size ③, Partial mode ON ④, Idle Mode ON ⑤ and Display ON ⑥ to thereby drive the display panel 10 in an OFF state, and reads out every three MSBs of pixel data of DLP image data from an (n+2)-th frame period that enters into the low power mode to supply the read data to the data lines of the display panel 10.

At a start time of the (n+1)-th frame period, the panel driver chip 100 reverses an output voltage of the second low power mode control terminal GPIO2 to a low logic level to thereby disable the DC-DC converter 50, and supplies an output voltage of the charge pump CP to the pixels 11 of the display panel 10 as a high potential power voltage VDDEL. While the low power mode is maintained after the start time of the (n+1)-th frame period, the panel driver chip 100 disables the DC-DC converter 50, and upon reentering into the normal mode, the panel driver chip 100 then enables the DC-DC converter 50.

The panel driver chip 100 increases the reference voltage VREF at the start time of the (n+1)-th frame period and then keeps the increased reference voltage VREF constant in the low power mode. Upon reentry into the normal mode, the panel driver chip 100 decreases the reference voltage VREF.

The panel driver chip 100 may keep a voltage of the first low power mode control terminal GPIO1 at a high logic level in the normal and low power modes, or alternatively, may reverse the voltage of the first low power mode control terminal GPIO1 to a low logic level from one frame before entering into the low power mode.

Figure 7:
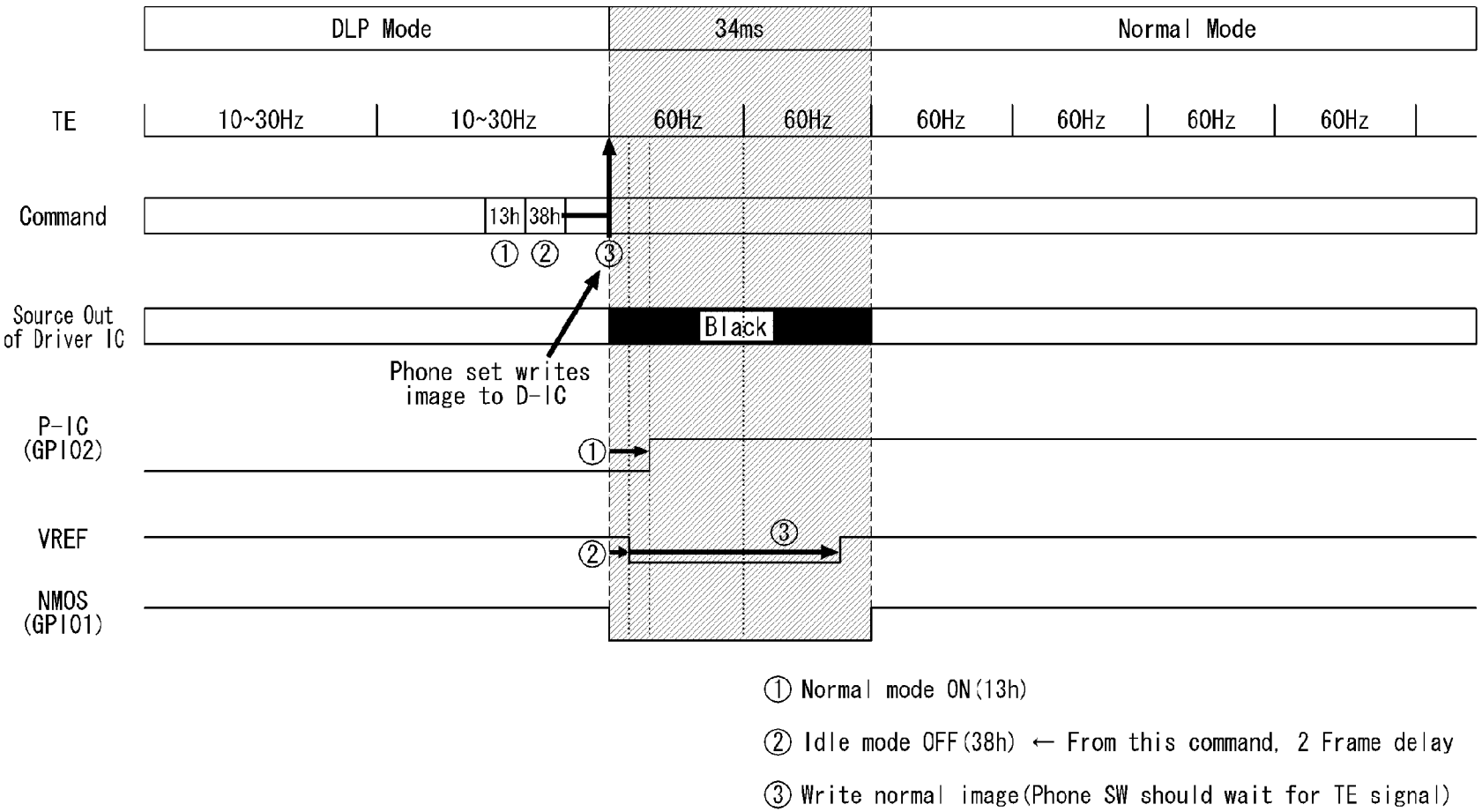
FIG. 7 is a timing diagram illustrating an operation of an OLED display according to an embodiment of the present document while the low power mode shifts to the normal mode.

FIG. 7 is a timing diagram illustrating an operation of an OLED display while the low power mode shifts to the normal mode.

Referring to FIG. 7, it is assumed that the low power mode includes an nth and (n+1)-th frame periods, and the normal mode includes an (n+2)-th to an (n+7)-th frame periods.

To enter from the low power mode into the normal mode, the host system 60 sequentially generates Normal mode ON ①, Idle mode OFF ②, and Write normal Image ③ during the (n+1)-th frame period. The Write normal Image ③ is synchronized with an n+1 TE pulse.

In response to the Normal mode ON ①, the panel driver chip 100 reverses an output voltage of the second low power mode control terminal GPIO2 to a high logic level during an (n+2)-th frame period to enable the DC-DC converter 50, and in response to the Idle mode OFF ②, and Write normal Image ③, decreases the voltage level of the reference voltage VREF during an (n+2)-th and (n+3)-th frame periods. Further, in response to the mode shifting commands, and from the host system 60, the panel driver chip 100 writes normal video data input from the host system 60 in an internal frame memory SRAM during the (n+2)-th and (n+3)-th frame periods to reverse a voltage of the first low power mode control terminal GPIO1 to a low logic level. The panel driver chip 100 supplies a black grayscale voltage to the data lines of the display panel 10 during the (n+2)-th and (n+3)-th frame periods.

Subsequently, the panel driver chip 100 converts the normal video data stored in the internal frame memory SRAM into a gamma compensation voltage from an (n+4)-th frame period that enters into the normal mode and supplies the converted data to the data lines of the display panel 10. In the normal mode, pixel data of the normal video data are written for every 24 bits (3 of R, G, and B×8 bits for each of R,G, and B=24 bits) in the internal memory SRAM of the panel driver chip 100, and for reproduction of a full color, every 24 bits are read out.

Figure 8:
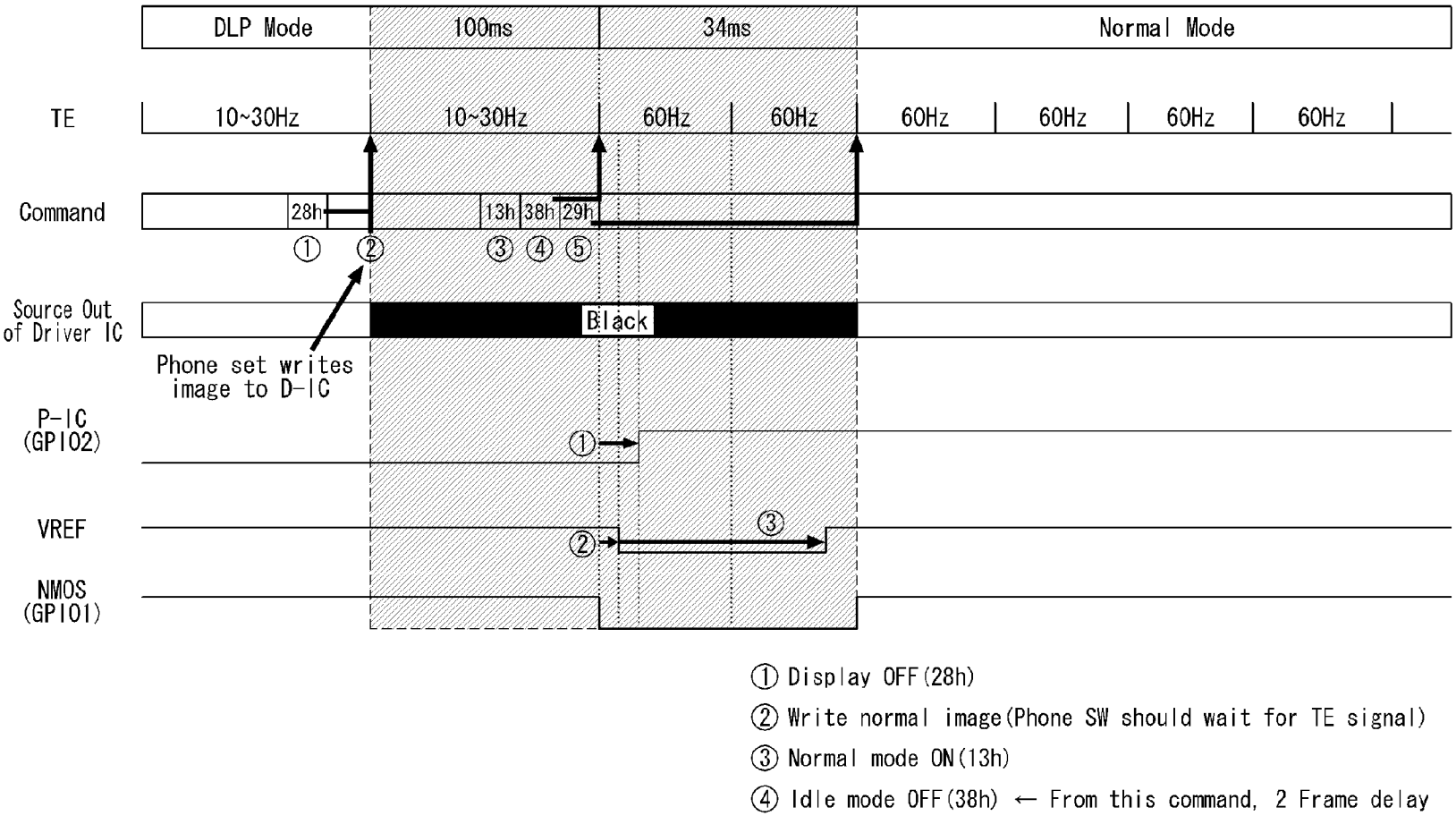
FIG. 8 is a timing diagram illustrating an operation of an OLED display according to an embodiment of the present document while the low power mode shifts to the normal mode.

FIG. 8 is a timing diagram illustrating an operation of an OLED display while the low power mode shifts to the normal mode.

Referring to FIG. 8, it is assumed that the low power mode includes an nth and (n+1)-th frame periods, and the normal mode includes an (n+2)-th to an (n+7)-th frame periods.

To enter from the low power mode into the normal mode, the host system 60 first generates Display OFF ① and Write normal Image ② during the nth frame period, and then sequentially generates Normal mode ON ③, Idle mode OFF ④, and Display ON ⑤ during the (n+1)-th frame period.

In response to the Display OFF, the panel driver chip 100 reverses an output voltage of the second low power mode control terminal GPIO2 to a high logic level during an (n+2)-th frame period to enable the DC-DC converter 50, and in response to the Write normal Image and Normal mode ON, decreases the voltage level of the reference voltage VREF during an (n+2)-th and (n+3)-th frame periods. Further, in response to the mode shifting commands , , , and from the host system 60, the panel driver chip 100 writes normal video data input from the host system 60 in an internal frame memory SRAM during the (n+2)-th and (n+3)-th frame periods to reverse a voltage of the first low power mode control terminal GPIO1 to a low logic level. The panel driver chip 100 supplies a black grayscale voltage to the data lines of the display panel 10 during the (n+2)-th and (n+3)-th frame periods.

Subsequently, the panel driver chip 100 converts the normal video data stored in the internal frame memory SRAM into a gamma compensation voltage from an (n+4)-th frame period that enters into the normal mode and supplies the converted data to the data lines of the display panel 10.

Figure 9:
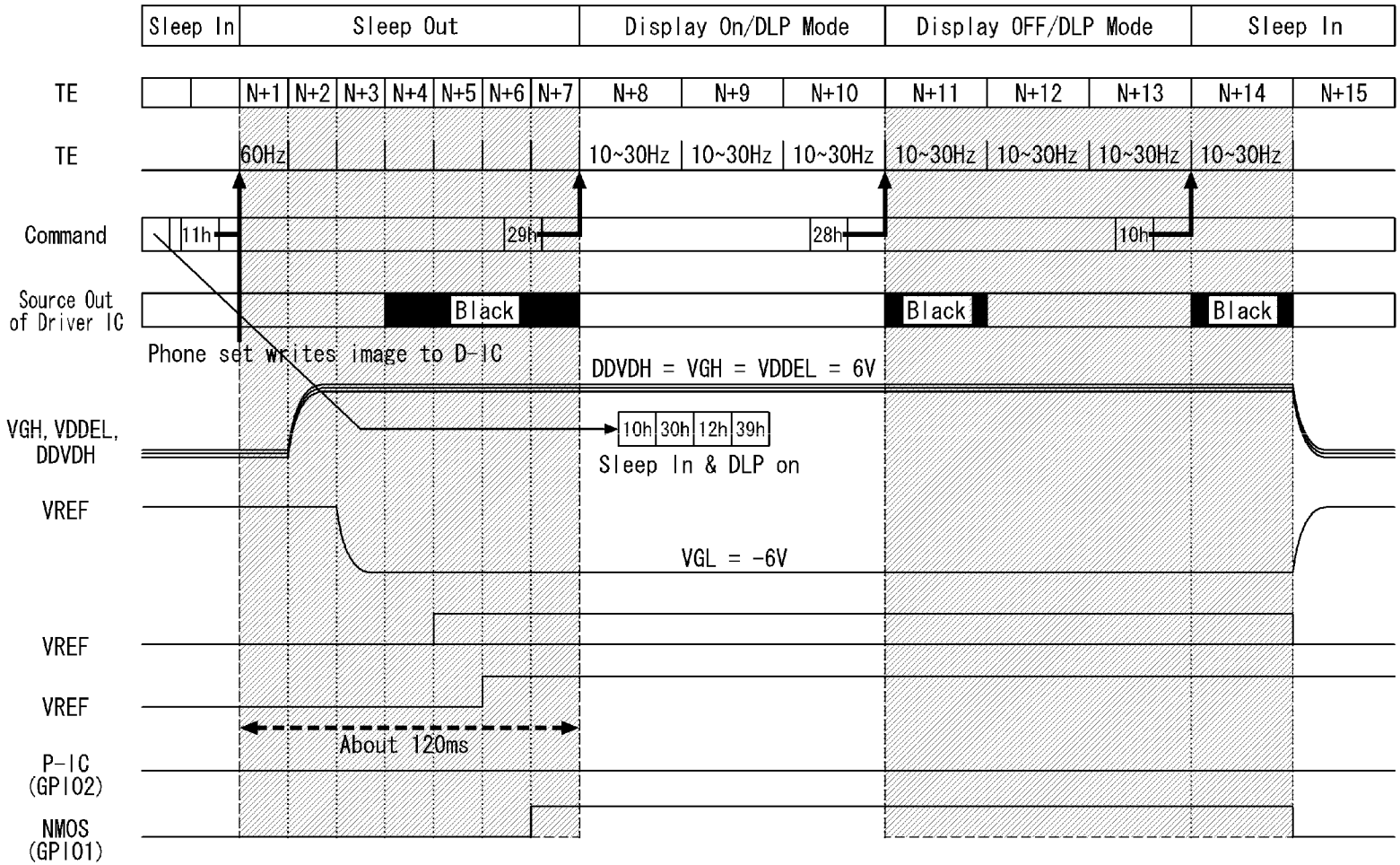
FIG. 9 is a timing diagram illustrating an operation of an OLED display according to an embodiment of the present document while shifting from a Sleep In mode to a low power mode.

FIG. 9 is a timing diagram illustrating an operation of an OLED display while shifting from a Sleep In mode to a low power mode (also referred to as a DLP mode).

Referring to FIG. 9, it is assumed that the Sleep In mode includes an n−1th and nth frame periods, and the a Sleep Out mode includes an (n+1)-th to (n+7)-th frame periods. It is also assumed that a Display On/DLP mode includes an (n+8)-th to (n+10)-th frame periods, and a Display Off/DLP mode includes an n+11 to (n+13)-th frame periods.

In the Sleep In mode, the host system 60 controls the OLED display to consume the minimum power. For example, the host system 60 stops the operation of the DC-DC converter 50 and an internal oscillator (not shown) in the Sleep In mode, as well as scanning of the display panel 10. Although the host system 60 and the memory operate in the Sleep In mode, the memory does not maintain the stored data. Also, the user input devices, such as a key board, or a key pad, are turned off in the Sleep In mode. The Sleep Out mode intervenes between the Sleep In mode and the low power mode. In the Sleep In mode, VGH, VDDEL, and DDVDH are maintained as the base voltage, and VGL is maintained as the high potential voltage.

In response to the mode shifting commands input from the host system 60, the panel driver chip 100 increases VGH, VDDEL, and DDVDH to normal operation voltages from a start time of the (n+2)-th frame period in the Sleep Out mode, and decreases VGL to the normal operation voltage from a start time of the (n+3)-th frame period. During the (n+1)-th to (n+3)-th frame periods, the panel driver chip 100 floats data output channels connected to the data lines of the display panel 10 to maintain the output channels in a high impedance state or to maintain the voltages of the data output channels as the base voltage GND. During the (n+4)-th to (n+7)-th frame periods, the panel driver chip 100 outputs black grayscale voltages through the data output channels connected to the data lines of the display panel 10, and begins to scan the display panel by enabling the scan driver from a start time of the (n+5)-th frame period to write the black grayscale voltages to the pixels of the display panel 10. The panel driver chip 100 increases the reference voltage VREF from a start time of the (n+6)-th frame period, and reverses the voltage of the first low power mode control terminal GPIO1 to a high logic level from a start time of the (n+7)-th frame period.

In response to the mode shifting commands input from the host system 60, the panel driver chip 100 enters into the Display On/DLP mode to supply DLP image data voltages to the data lines of the display panel 10. While shifting from the Display On/DLP mode to the Display Off/DLP mode, the panel driver chip 100 supplies a black grayscale voltage to the data lines of the display panel 10 during a first frame period. While shifting from the Display Off/DLP mode to the Sleep In mode, the panel driver chip 100 supplies a black grayscale voltage to the data lines of the display panel 10 during a first frame period.

FIG. 11 is a view illustrating a gamma correction circuit of the panel driver chip 100.

Referring to FIG. 11, the gamma correction circuit includes a first voltage dividing circuit 110, an amplifier 120, a second voltage dividing circuit 130, a grayscale generating circuit 140, a decoder 150, an output buffer 160, and fourth to sixth switches SW4, SW5, and SW6.

The first voltage dividing circuit 110 includes a resistor string R-string that includes one or more resistors connected in series to each other. The first voltage dividing circuit 110 divides a voltage into VRE2OUT and VGS to generate gamma reference voltages. The gamma reference voltages output from the first voltage dividing circuit 110 are separated into grayscale voltages of digital video data through the amplifier 120, the second voltage dividing circuit 130, and the grayscale generating circuit 140. In response to the digital video data, the decoder 150 selects an analogue grayscale voltage for each grayscale and supplies a data voltage Vdata to the data lines of the display panel 10 through the output buffer 160.

Since in the normal mode, RGB data are read out by 8 bits for each of R, G, and B from the frame memory of the panel driver chip 100, the amplifiers and buffer connected to the output terminals of the first voltage dividing circuit 110 normally operate. In the normal mode, the fourth to sixth switches SW4 to SW6 maintain an OFF state.

In the low power mode, the RGB data are outputted by one MSB for each of R, G, and B from the frame memory of the panel driver chip 100. According to an embodiment, only the amplifier 120 that amplifies the uppermost gamma reference voltage corresponding to one MSB is enabled, and the other amplifiers are not required and thus disabled. According to an embodiment, the fourth switch SW4 turns on in the low power mode to directly supply an output voltage of the amplifier 120 to the decoder 150, thus minimizing power consumption by the second voltage dividing circuit 130 and the grayscale generating circuit 140. According to an embodiment, the fifth switch SW5 turns on in the low power mode so that an output voltage of the decoder 150 is directly supplied to the data lines of the display panel 10 without passing through the buffer 160, thereby minimizing current to the output buffer 160. According to an embodiment, the sixth switch SW6 turns on in the low power mode to connect the voltage lines applied with the other grayscale voltages than the upper most grayscale voltage to the ground voltage source GND, thereby preventing gray scale voltages from being unnecessarily applied to the voltage lines.

According to the embodiments of the present document, as the OLED display entering into the low power mode, a high potential power voltage generated from the panel driver chip is supplied to the display panel with the DC-DC converter disabled, and a display state of the display panel is controlled in an OFF state at an early stage of the low power mode. As a consequence, the OLED display may be prevented from exhibiting an abnormal screen in the low power mode with minimized power consumption.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display, comprising:

a display panel that comprises data lines, scan lines intersecting the data lines, and light emitting cells arranged in a matrix form, the light emitting cells respectively comprising OLEDs;

a DC-DC converter that is enabled in a normal mode to supply a first high potential power voltage to the display panel and is disabled in a low power mode; and a panel driver that drives the data lines and the scan lines of the display panel, disables the DC-DC converter in the low power mode, and supplies a second high potential power voltage to the display panel, wherein the second high potential power voltage is produced in the panel driver.

2. The organic light emitting diode (OLED) display of claim 1, wherein the DC-DC converter comprises a feedback resistor connected to a high potential driving voltage supply terminal of the display panel and a switch switching on/off a current path between a terminal of the feedback resistor and a ground voltage source, wherein the switch turns on/off in the low power mode under control of the panel driver to cut off the current path.

3. The organic light emitting diode (OLED) display of claim 1, wherein the panel driver comprises a charge pump that adjusts an input voltage to output the second high potential power voltage, a diode connected to the high potential power voltage supply terminal of the display panel, and a first switch that supplies the second high potential power voltage to the display panel through the diode in the low power mode in response to a mode shifting command input from an external host system.

4. The organic light emitting diode (OLED) display of claim 1, wherein in the normal mode, the panel driver gamma corrects RGB data for every full bits and supplies the gamma-corrected RGB data to the data lines of the display panel, and in the low power mode, gamma corrects the RGB data only for MSBs and supplies the gamma-corrected RGB data to the data lines of the display panel.

5. The organic light emitting diode (OLED) display of claim 1, wherein the panel driver comprises:

a first voltage dividing circuit that produces a gamma reference voltage, a second voltage dividing circuit that separates an output voltage of the first voltage dividing circuit;

one or more amplifiers that amplify respective corresponding outputs from the first voltage dividing circuit and supply the amplified outputs to the second voltage dividing circuit;

a grayscale voltage generating circuit that generates grayscale voltages by adjusting an output voltage of the second voltage dividing circuit;

a decoder that selects a grayscale voltage depending on digital video data; and an output buffer that supplies an output voltage from the decoder to the data lines of the display panel, wherein in the low power mode, only an amplifier that amplifies a uppermost grayscale gamma reference voltage among the one or more amplifiers is enabled and the other amplifiers are disabled.

6. The organic light emitting diode (OLED) display of claim 5, wherein the panel driver further comprises:

a fourth switch that switches on/off a current path between an output terminal of the amplifier that amplifies the uppermost grayscale gamma reference voltage and an output terminal of the decoder through which a uppermost grayscale voltage is outputted, a fifth switch that switches on/off a current path between an input terminal and an output terminal of the output buffer, and a sixth switch that switches on/off a current path between the ground voltage source and voltage lines for supply of other grayscale voltages than the uppermost grayscale voltage.

7. The organic light emitting diode (OLED) display of claim 6, wherein the fourth to sixth switches turn on in the low power mode.

8. The organic light emitting diode (OLED) display of claim 1, wherein the high potential power voltage supplied to the display panel is lower in the low power mode than in the normal mode.

9. The organic light emitting diode (OLED) display of claim 1, wherein a frame period of the low power mode is longer than a frame period of the normal mode.

10. The organic light emitting diode (OLED) display of claim 1, wherein the panel driver supplies a black grayscale voltage to the data lines of the display panel during at least a portion of a time period that shifts from the normal mode to the low power mode.

11. The organic light emitting diode (OLED) display of claim 1, wherein the panel driver increases a reference voltage supplied to each of the light emitting cells of the display panel at an early stage of the low power mode.

12. A low power driving method of an organic light emitting diode (OLED) display comprising a display panel that comprises data lines, scan lines intersecting the data lines, and light emitting cells respectively comprising OLEDs, and a panel driver driving the data lines and the scan lines of the display panel, the method comprising:

enabling a DC-DC converter in a normal mode to supply a first high potential power voltage produced from the DC-DC converter to the display panel; and disabling the DC-DC converter in a low power mode to supply a second high potential power voltage produced from the panel driver to the display panel.

13. The method of claim 12, further comprising cutting off a current path between a feedback resistor of the DC-DC converter and a ground voltage source in the low power mode.

14. The method of claim 12, further comprising gamma correcting RGB data for all RGB data bits in the normal mode to supply the gamma-corrected RGB data to the data lines of the display panel; and gamma correcting the RGB data only for MSBs in the low power mode to supply the gamma-corrected RGB data to the data lines of the display panel.

15. The method of claim 12, wherein the high potential power voltage supplied to the display panel is lower in the low power mode than in the normal mode.

16. The method of claim 12, wherein a frame period of the low power mode is longer than a frame period of the normal mode.

17. The method of claim 12, wherein the panel driver supplies a black grayscale voltage to the data lines of the display panel during at least a portion of a time period that shifts from the normal mode to the low power mode.

* * * * *